US007916024B2

(12) United States Patent
Gennard

(10) Patent No.: US 7,916,024 B2
(45) Date of Patent: Mar. 29, 2011

(54) MUSTER APPARATUS

(75) Inventor: Derek Gennard, Rotherham (GB)

(73) Assignee: S3 ID Limited, Rotherham (GB)

( * ) Notice: Subject to any disclaimer, the term of this patent is extended or adjusted under 35 U.S.C. 154(b) by 358 days.

(21) Appl. No.: 11/815,730

(22) PCT Filed: Feb. 7, 2006

(86) PCT No.: PCT/GB2006/000389

§ 371 (c)(1),
(2), (4) Date: Nov. 26, 2007

(87) PCT Pub. No.: WO2006/085056

PCT Pub. Date: Aug. 17, 2006

(65) Prior Publication Data

US 2008/0129467 A1 Jun. 5, 2008

(30) Foreign Application Priority Data

Feb. 8, 2005 (GB) ..... 0502527.5

(51) Int. Cl.
*G08B 13/14* (2006.01)

(52) U.S. Cl. ..... 340/572.1; 340/572.2; 340/572.7; 340/573.1; 340/286.11; 343/867; 343/893; 343/894

(58) Field of Classification Search ..... 340/572.1, 340/572.2, 572.7, 573.1, 286.11; 343/867, 343/893, 894
See application file for complete search history.

(56) References Cited

U.S. PATENT DOCUMENTS

| | | | | |
|---|---|---|---|---|
| 5,459,305 | A | 10/1995 | Eriksson | |
| 5,682,142 | A * | 10/1997 | Loosmore et al. | 340/572.1 |
| 6,057,764 | A * | 5/2000 | Williams | 340/572.1 |
| 6,703,935 | B1 | 3/2004 | Chung et al. | |
| 2004/0102178 | A1 | 5/2004 | Williams | |

FOREIGN PATENT DOCUMENTS

| | | |
|---|---|---|
| GB | 2277850 | 11/1994 |
| RU | 1837339 A1 | 8/1993 |
| RU | 2110192 C1 | 5/1998 |

* cited by examiner

*Primary Examiner* — George A Bugg
*Assistant Examiner* — Sisay Yacob
(74) *Attorney, Agent, or Firm* — Chernoff, Vilhauer, McClung & Stenzel

(57) ABSTRACT

Muster apparatus for registering the arrival of a person at a location includes detector means for detecting the arrival of the person at the location and a controller, the detector means being in signal communication with the controller. The apparatus includes output means for communicating information from the controller to an operator. The apparatus is arranged so that the information communicated is dependent on the arrival of the person at the location.

15 Claims, 4 Drawing Sheets

MUSTER APPARATUS

The present invention relates to muster apparatus, particularly but not exclusively muster apparatus for registering the arrival of a person at a location.

It is an accepted safety practice that non domestic buildings such as schools, hospitals, hotels, nursing homes and work places include a location which is designated as a muster point or muster station. In an emergency situation, such as a fire, the occupants of the building are directed to the muster station for registration. Any persons missing from registration can then be identified, and appropriate action taken by the emergency services.

For relatively small buildings with only one muster station, the provision of a registration list against which the names of evacuated personnel can be ticked off is adequate. However such a system can be unsatisfactory for a number of reasons. There may be a plurality of muster stations. The building may contain unregistered personnel such as visitors. In an emergency situation conditions at the muster station itself may not be ideal and may make the registration procedure difficult.

In a larger building or site, personnel may be required to muster at specific locations, irrespective of their actual locations at the time of the muster, entailing longer evacuation routes.

Particular problems exist in the case of offshore oil and gas installations. Since the Piper Alpha disaster, such installations have been subject to stringent safety precautions, involving regular rehearsal of emergency evacuation procedures. Offshore oil and gas installations are large and complex structures and a plurality of muster stations may be designated. Safety regulations stipulate that during the evacuation procedures, all personnel must be accounted for before normal operation of the installation recommences, and thus, such evacuation procedures can be very disruptive to the operation of the installation.

According to the present invention, there is provided muster apparatus for registering the arrival of a person at a location, the apparatus including detector means for detecting the arrival of the person at the location, a controller, the detector means being in signal communication with the controller, the apparatus including output means for communicating information from the controller to an operator, the apparatus being arranged so that the information communicated is dependent on the arrival of the person at the location.

Preferably, the information communicated includes an identifier which is associated with the identity of the person.

Preferably, the information communicated includes a register, which may comprise a plurality of identifiers, and each identifier may be associated with a different person expected at the location.

Preferably, the information communicated includes an indicator associated with the or each identifier, which indicates whether the person associated with the identifier has arrived at the location. Preferably, the apparatus is arranged so that when the person arrives at the location the indicator changes from a first condition indicating that the person has not arrived to a second condition indicating that the person has arrived.

Preferably the detector means are arranged to automatically detect the arrival of the person at the location. Preferably, the detector means include an identity tag which in use is carried by the person, and may include a plurality of identity tags, each of which may be carried by a different person. Preferably, the or each identity tag includes means for storing an identification code, the identification code being associated with the identifier.

Preferably, the detector means include an input device. Preferably, the detector means include communication means which are arranged to permit automatic communication of the identification code from the identity tag to the input device when the person arrives at the location.

Preferably the output means include display means for communicating the information to the operator.

Preferably, the apparatus includes a plurality of spaced input devices, each input device being associated with a different location, for detecting the arrival of a person at that location.

The information communicated may include a register for each location, and may include a master register, which includes all the identifiers comprising the registers.

The information communicated may include an indication that a person expected at one location has arrived at another location.

Preferably, the or each location is a muster station for mustering personnel in an emergency. The or each location may be part of a defined area. The defined area may be an offshore oil and gas installation.

The apparatus may include means for updating the or each register when personnel enter or leave the defined area. The updating means may include an input device located at an entry to the defined area in signal communication with the controller.

The controller may be a programmable computer, which may be programmable with a set of instructions.

Preferably, the set of instructions includes an identity database which relates the or each identification code to the or each identifier.

Preferably, the set of instructions includes a register database, which relates the or each identifier to the or each location.

Preferably, the communication means include wireless communication means and may more preferably include radio communication means. The communication means may include a radio transmitter-responder (transponder). The or each identity tag may include the transponder. The communication means may include a radio transmitter and receiver. The or each input device may include the radio transmitter and receiver.

The transponder may be in the form of an RFID device.

Preferably, the or each input device includes an antenna, which may be arranged to create a read field space. The antenna may be arranged to receive an identification code from an identity tag when the tag is within the read field space. The read field space may be circular or elliptical in plan, and may extend up to 2 m from the input device.

The apparatus may include an allocation input device, which may be in signal communication with the controller, and may permit input of identification codes and their associated identifiers to the identity database.

The controller may include monitoring means, which may include an alarm, which may be audible and/or visual.

Preferably, the controller is arranged to record the information communicated. Preferably, the controller includes memory storage for the recorded information. Preferably, the controller includes retrieval means for retrieving the recorded information from the memory storage.

The apparatus may include a back up controller, which may be in signal communication with the controller. The back up controller may be sited at a remote location from the controller.

The identity tags, input devices and/or controller may be suitable for use in hazardous areas.

The controller may include interface means for interfacing with other systems, which may include tracking, logistics and/or personnel systems.

According to the present invention, there is provided a method for registering the arrival of a person at a location, the method including providing muster apparatus, the apparatus including detector means for detecting the arrival of the person at the location, a controller, the detector means being in signal communication with the controller, the apparatus including output means for communicating information from the controller to an operator, the apparatus being arranged so that the information communicated is dependent on the arrival of the person at the location.

Preferably, the muster apparatus is as described in any of the preceding paragraphs.

Embodiments of the present invention will now be described, by way of example only, and with reference to the accompanying drawings, in which:—

Figure 1:
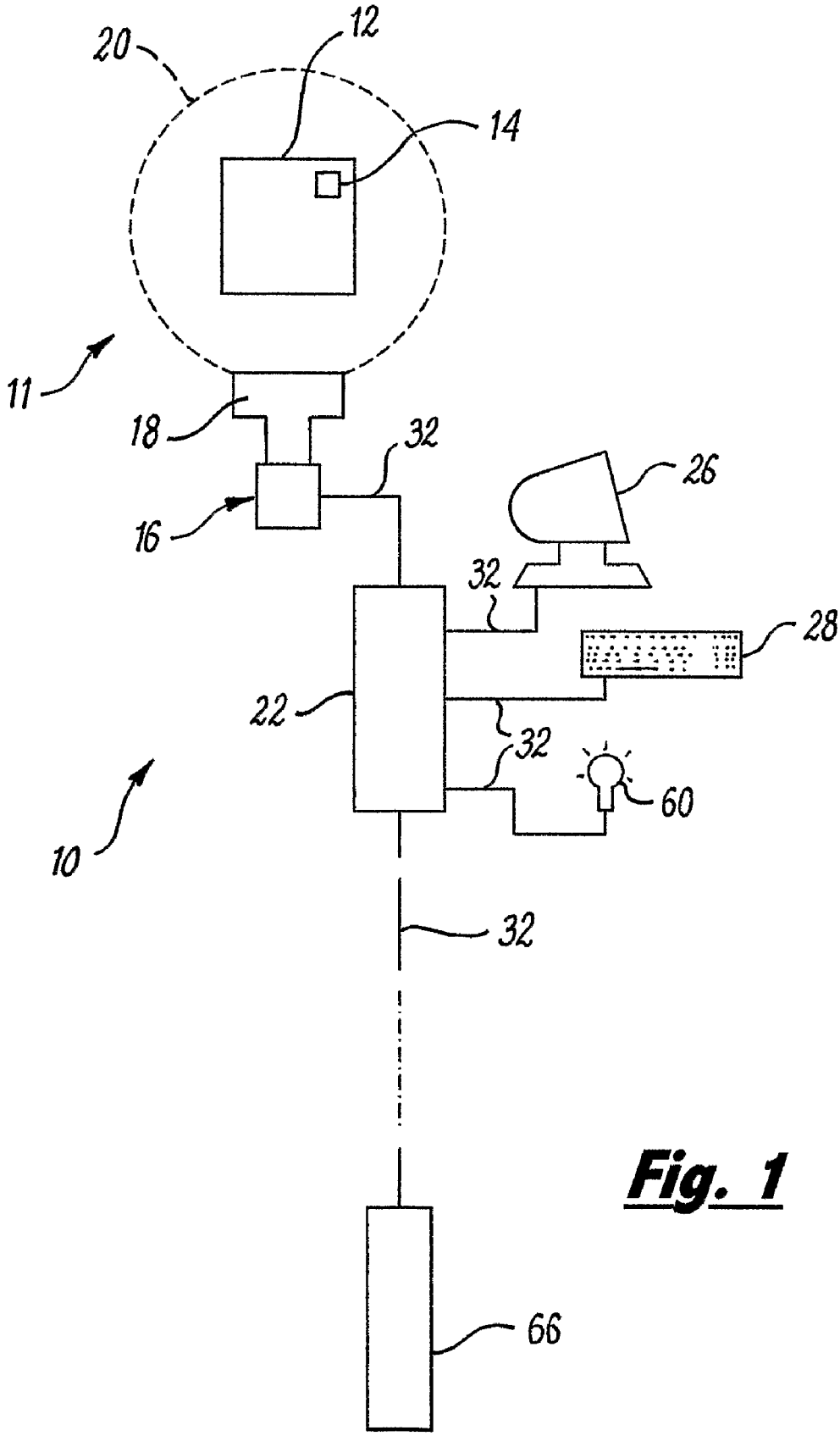
FIG. 1 is a schematic diagram of a muster apparatus.

FIG. 1 shows in schematic form a muster apparatus 10 including detector means 11 for automatically detecting the arrival of a person at a location. The detector means 11 include an identity tag 12, the identity tag 12 including a radio transmitter-responder (transponder) in the form of a radio frequency identification (RFID) device 14.

The detector means 11 include an input device 16, the input device 16 including an antenna 18 which is arranged to create a read field space 20. The read field space 20 in the example shown in FIG. 1 is generally circular in plan, and could extend up to 2 m from the antenna 18.

The apparatus 10 includes a controller in the form of a programmable computer 22. The apparatus 10 includes output means for communicating information from the computer 22 to an operator, the output means including display means in the form of a display screen 26. The apparatus 10 includes a user input device in the form of a keyboard 28.

The muster apparatus 10 includes a back up computer 66 which could be located remotely from the computer 22. The muster apparatus 10 includes an alarm 60 which could be a visual and/or audible alarm.

The input device 16, the display screen 26, the keyboard 28, the backup computer 66 and the alarm 60 are each in signal communication with the computer 22 by means of cable connections 32. Alternatively, the cable connections 32 could be replaced by any suitable form of connection providing signal communication, such as wireless connections.

Figure 2:
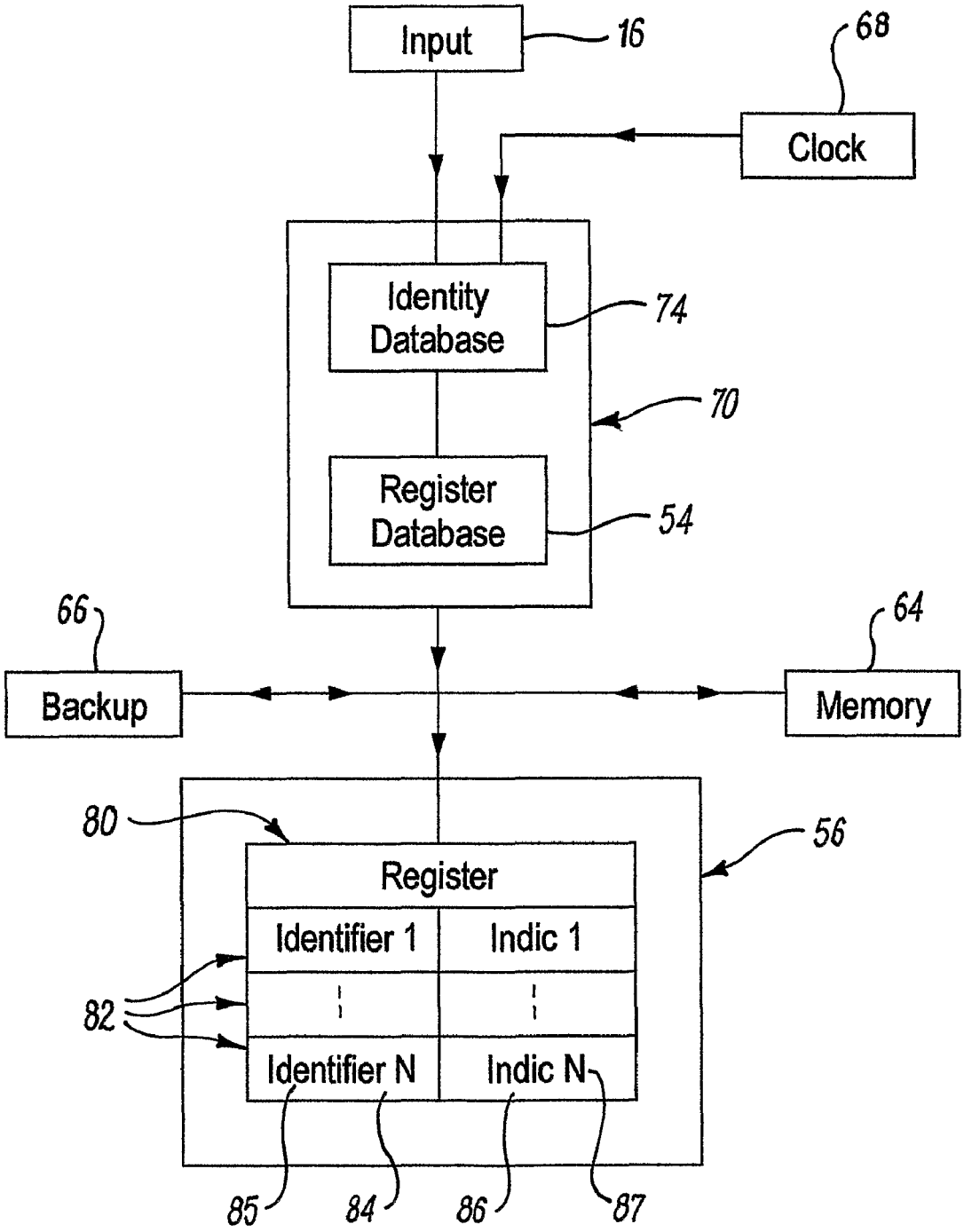
FIG. 2 is a schematic block diagram of part of the apparatus.

The computer 22 is programmed with a set of instructions 70 which is shown in block diagram form in FIG. 2. The set of instructions 70 includes an identity database 74 and a register database 54. The computer 22 includes a clock 68 and memory storage 64.

In use, each RFID device 14 includes a unique identification code. Initially, a new user, who may be a visitor to a factory or an offshore oil and gas installation, or who may be a new employee, is allocated an identity tag 12 which is brought within the read field space 20 of the input device 16. The input device 16 operates as follows. As the identity tag 12 is brought within the read field space 20 generated by the antenna 18, the RFID device 14 gains power from the signal generated by the antenna 18 within the read field space 20. In response to the signal generated by the antenna 18, the RFID device transmits the identification code to the input device 16. Thus the identification code is transmitted automatically when the identity tag 12 comes within the read field space 20 of the input device 16.

In the case of a new user, the identification code is communicated via the cable connections 32 to the computer 22 and then to the display screen 26. At the display screen 26, an operator can then input data relating to the new user into the identity database 74 by means of the keyboard 28, thus relating each identification code to associated identity information of the respective user. The identity information could include any appropriate information, including an identifier such as a name or number, an address, next of kin, profession, employer, passport number and medical records.

In the case of the example shown in FIG. 1, the location at which the arrival of persons is registered is defined by the read field space 20. The apparatus 10 could be arranged so that the read field space 20 extends across the opening of a doorway or gateway, so that persons passing through the doorway or gateway into a designated muster area are registered as arriving at the muster area.

As a person arrives at the location, the identity tag 12 is brought within or passes through the read field space 20 of the input device 26, and the RFID device 14 transmits the identification code to the input device 16 as described previously. This transmission is automatic, and requires no input from the person carrying the identity tag 12. The identity data base 74 relates the identification code to an identifier. The register data base is amended to register the arrival of the person associated with the identifier at the location.

FIG. 2 shows an example of the information communicated to the operator via the display screen 26. The information communicated 56 includes a register 80, which comprises a plurality of register records 82. Each register record 82 comprises an identifier field 84 and an indicator field 86, the identifier field 84 comprising an identifier 85, and the indicator field 86 comprising an indicator 87. Thus the register 80 communicates a plurality of identifiers 85 which are shown in FIG. 2 as Identifier 1 . . . Identifier N with respective indicators 87 which are shown as Indic 1 . . . Indic N.

The apparatus 10 is arranged so that when a person arrives at the location and the identification code is transmitted, the indicator 87 associated with the identifier 85 relating to that person changes from a first condition indicating that the person has not arrived to a second condition indicating that the person has arrived. Thus, the register 80 displayed on the display screen 26 shows the operator who has arrived at the location.

The information communicated 56 is stored in memory storage 64 with associated time information provided by the clock 68, so that a record is kept of the arrival of persons at the location. The computer 22 includes retrieval means for retrieving the recorded displayed output from the memory storage 64.

The muster apparatus of FIG. 1 is of particular use in registering the arrival of persons at a muster station in an emergency situation, or in a simulation of an emergency situation such as a fire drill. As persons arrive at the location, the register 80 is automatically and accurately updated, and the non arrival of any persons can be quickly identified. The alarm 60 could be arranged to alert the operator to the arrival of persons after the elapse of a specified time period. The arrival of persons at the muster location could be timed, identifying any problems with escape routes, and the register records can be archived to show to regulatory authorities that statutory drills have been performed.

Figure 3:
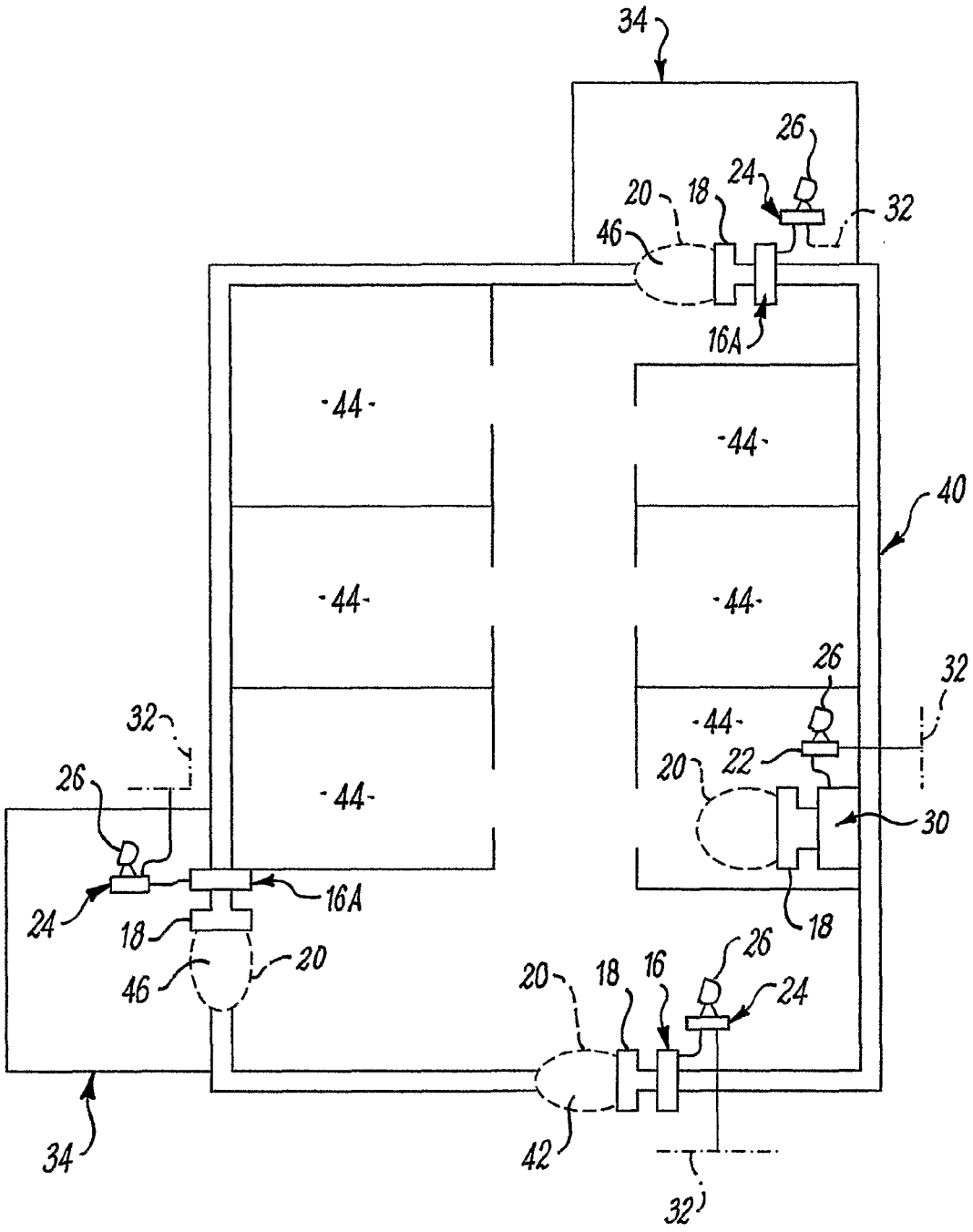
FIG. 3 is a schematic plan of a building.

The apparatus shown in FIGS. 1 and 2 is a relatively simple stand alone apparatus. FIG. 3 shows a plan of a defined area in the form of a building 40 in which a muster apparatus is installed. The building 40 could, for instance, be an accommodation block or a working area of an offshore oil and gas installation or other work place environment, a hotel, school, hospital or any other public building. The building 40 includes a main entrance 42 and a plurality of rooms 44, and includes a pair of outlying muster spaces 34, with interconnecting doorways 46 between the muster spaces 34 and the building 40. An input device 16 is positioned at the main entrance 42 and at each of the interconnecting doorways 46, so that the read field space 20 of each of the input devices 16 extends fully across the width of the respective main entrance 42 and the doorways 46. In the example shown in FIG. 3, the read field spaces 20 are elliptical in plan. Thus in comparison with the arrangement shown in FIG. 1, the arrangement of the muster apparatus shown in FIG. 3 includes a plurality of muster stations.

The muster apparatus of FIG. 3 includes an allocation input device 30, which includes an antenna 18 which generates a spherical read field space 20. The allocation input device 30 is in signal communication with a controller in the form of a computer 22, which is in signal communication with a display screen 26. Each of the input devices 16 is in signal communication with a local terminal 24, which is in signal communication with a display screen 26. Each of the local terminals 24 are in signal communication by means of signal connections in the form of cabling 32 with a computer 22.

Figure 4:
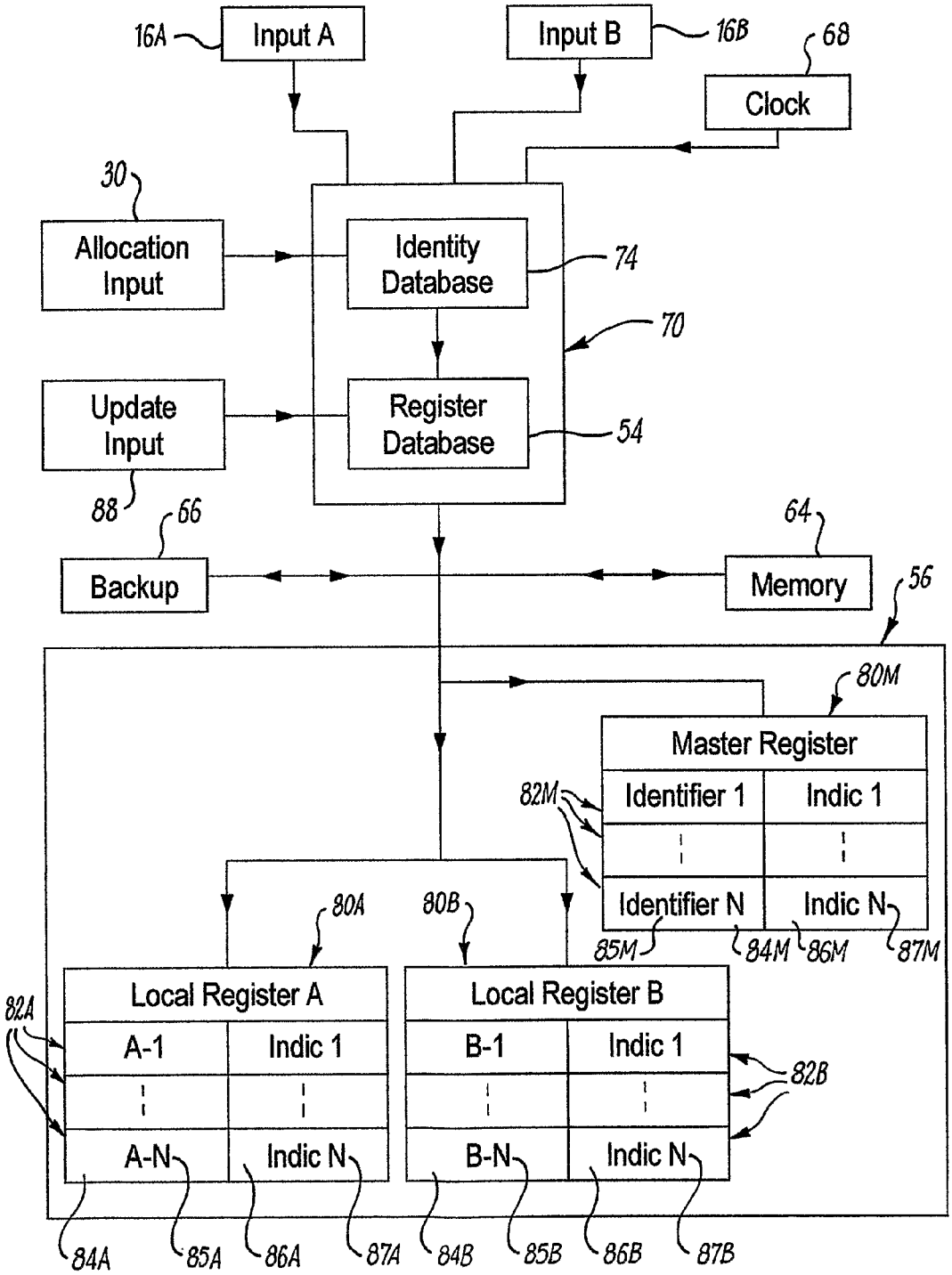
FIG. 4 is a schematic block diagram of another apparatus.

The operation of the muster apparatus of FIG. 3 is shown schematically in FIG. 4, and is similar to the operation of the example shown in FIGS. 1 and 2. Initially, a new user, who may be a visitor to the building, or may be a new employee, is allocated an identity tag 12, which is brought within the read field space 20 of the allocation input device 30. The allocation input device 30 and each of the input devices 16 operate in a similar manner to that described previously for the example shown in FIGS. 1 and 2, the RFID device of the identity tag 12 transmitting an identification code to the allocation input device 30 or the input device 16 in response to the signal generated by the antenna 18 within the read field space 20, the identification code being transmitted automatically when the identity tag 12 comes within the read field space 20 of either the allocation input device 30 or the input device 16.

In the case of a new user, the identification code is communicated via the cable connections 32 to the computer 22 and then to the display screen 26. At the display screen 26, an operator can then input data relating to the new user into the identity database 74, the identity information input including any appropriate identifiers such as a name or number.

The computer 22 is programmed with a set of instructions 70 which is shown in block diagram form in FIG. 4. The set of instructions 70 includes an identity database 74 and a register database 54. The identity database 74 includes a plurality of records, each record relating to a user and including information relating to that user such as an identifier, the user's name, address, and the muster station to which the user is allocated.

The register database 54 relates each identifier to each muster station.

In use, the muster apparatus of FIG. 3 operates as follows. In an emergency situation, or a simulation of an emergency situation such as a fire drill, all of the users in the building 40 will move towards the nearest muster station 34. This may or may not be the muster station to which each user has been allocated, depending upon the location of the user in the building at the time of the emergency. As each user passes through each of the read field spaces 20 extending across the doorways 46, the identification code is automatically transmitted from the RFID device 14 of the identity tag 12 being carried by each user to the respective input device 16, and is then communicated in turn from the input device 16 to the local terminal 24 and the computer 22. Schematically as shown in FIG. 4 these inputs are shown as input A and input B from input devices 16A, 16B respectively. As each of the inputs 16A, 16B is received by the computer 22, the set of instructions 70 is arranged so that information is communicated from the computer 22 to an operator via the display screens 26. The identity database 74 relates the identification code communicated to each of the input devices 16A, 16B to the identifier relating to the person carrying the tag 12. The register database 54 relates the identifier to the appropriate muster station 34.

FIG. 4 shows the information communicated 56, which includes local register A, 80A, local register B, 80B and master register 80M. Local register A relates to the users whose arrival is expected at muster station A and local register B relates to those users whose arrival is expected at muster station B. The muster register 80M includes the identifiers of all users.

Each of the registers 80A, 80B, 80M includes a plurality of records 82A, 82B, 82M respectively. Taking register A as a representative example, each record 82A comprises an identifier field 84A and an indicator field 86A. Each of the identifier fields 84A comprises an identifier 85A, and each of the indicator fields comprises an indicator 87A. Register A thus communicates a plurality of identifiers 85A which are shown in FIG. 4 as A-1 . . . A-N with respective indicators 87A which are shown as Indic 1 . . . Indic N. Registers B and M communicate similar information.

Each of the indicators 87A, 87B, 87M is initially in a first condition indicating that the person associated with the respective identifier 85A, 85B, 85M has not yet arrived at the respective muster station.

As users arrive at the muster stations 34, the respective indicators 87A, 87B, 87M, change from the first condition to a second condition indicating that the person has arrived at the muster station. The apparatus is arranged so that the arrival of each person is automatically detected, and the local and master registers are updated to indicate that the person has arrived at the location.

As mentioned previously, in an emergency situation, there is a possibility that users will evacuate to a muster station to which they have not been allocated, and the appropriate local register will not therefore be updated to show that in fact they have safely evacuated to a muster station. In this case, the master register 80M shows a full list of all personnel, and respective indicators 87M show whether those personnel have evacuated to any muster station.

The successful evacuation of persons to different muster stations could be shown in a number of ways. For instance, each register could include a set of indicators relating to the actual people who have arrived at that muster station, and another set of indicators relating to people who have arrived at all muster stations. The indicators 87 could be of any suitable form.

Over a period of time, users will enter and leave the building 40 through the main entrance 42, and as each user enters or exits the building, an update input 88 is generated by the input device 16 to the computer 22, which undates the register database 54. Thus for example, as a person allocated to muster station A enters the building, that person's identifier is added by the update input 88 to the register database 54, and on leaving the building, that person's identifier is removed from the register database 54. Thus the register database 54 is updated to reflect the users within the building 40 at any time.

Various modifications may be made without departing from the scope of the invention. The RFID device used could be self powered and could include a battery and could be programmable. Although the apparatus described includes RFID device, any suitable communication means which permits automatic communication of the identification code from the identity tag to the input device could be used. The read field space could be of any suitable size or shape. The identity information could include any suitable information. The various components of the apparatus could be designed for use in hazardous areas and could comply with internationally recognised standards for intrinsically safe operation.

The set of instructions could include a routine which monitors the number of persons arriving at the muster station, in comparison with a predetermined capacity. The capacity could, for instance, be the capacity of a lifeboat. If the capacity is exceeded, the routine could activate an alarm or warning device.

The apparatus could include any number of input devices located at any number of muster stations and/or any number of entrances and exits and/or at any other suitable locations. For example, a muster station could be in a lifeboat, and an input device could be located in a roof of the lifeboat. In another example, a muster system could be in a helicopter.

The computer could include interface means for interfacing with other systems, and in particular could interface with systems such as tracking systems for tracking the location of personnel.

There is thus provided muster apparatus for registering the arrival of persons at a location. The apparatus is arranged so that when the identity tag is carried by the user, no further intervention by the user is required, as the identification code is automatically communicated from the identity tag to the input device. Contact between the identity tag and the input device is not required, and neither is line of sight between the identity tag and the input device. Thus the user can move around between locations unhindered, and unconscious of the presence of the muster apparatus. In an emergency situation, the user is not hindered in moving from one location to another. The apparatus will continue to operate in emergency conditions, for example in smoke filled environments and/or in darkness. Large numbers of people can be mustered accurately and quickly, with reduced risk of mistaken identity and mistakes due to operator error, panic or poor environmental conditions. The apparatus permits dedicated communication between muster locations, allowing the non arrival of persons to be swiftly and accurately identified and appropriate action to be taken at an early stage. The arrival of persons at muster stations to which they are not allocated can be registered, improving safety.

The apparatus is of particular benefit on offshore oil and gas installations, where regular emergency procedures must be practiced. In these emergency procedures, every person present on the installation must be accounted for before normal operation can recommence, and the muster apparatus permits accurate monitoring of the arrival of persons at a plurality of spaced muster stations and the recommencement of normal work as soon as all persons have been accounted for. Thus the downtime of oil or gas production can be minimised while fulfilling the requirements of the regulations relating to the performance of emergency procedures.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. Muster apparatus for registering the arrival of people expected at a plurality of muster stations, wherein the people are associated with different respective identifiers and the apparatus comprises detector means which include a plurality of spaced input devices associated with the muster stations respectively, for detecting the arrival of people at the respective muster stations, a controller in signal communication with the input devices, and output means for communicating information from the controller to an operator, the apparatus being arranged so that the information communicated is dependent on the arrival of people at the respective muster stations, the information communicated including a local register for each muster station, the local register comprising the respective identifiers associated with the persons expected at the muster station and a set of indicators relating to the actual people who have arrived at that muster station, and the information communicated also including a master register comprising all the identifiers comprising the local registers and a set of indicators relating to people who have arrived at all muster stations.

2. Apparatus according to claim 1, in which the apparatus is arranged so that when a person arrives at a muster station the indicator changes from a first condition indicating that the person has not arrived to a second condition indicating that the person has arrived.

3. Apparatus according to claim 1, in which the detector means are arranged to automatically detect the arrival of the person at the location.

4. Apparatus according to claim 1, in which the detector means include a plurality of identity tags, each of which is carried by a different person.

5. Apparatus according to claim 1, in which the detector means include one or more identity tags, and the or each identity tag includes means for storing an identification code, the identification code being associated with an identifier associated with a person carrying the identity tag.

6. Apparatus according to claim 1, in which the detector means include one or more identity tags, and at least one identity tag includes means for storing an identification code, the identification code being associated with an identifier associated with a person carrying the identity tag, the detector means being arranged to permit automatic communication of the identification code from the identity tag to the input device at a muster station when the person arrives at the muster station.

7. Apparatus according to claim 1, in which each muster station is part of a defined area.

8. Apparatus according to claim 1, in which each muster station is part of a defined area, and the defined area is an offshore oil or gas installation.

9. Apparatus according to claim 1, in which each muster station is part of a defined area, the apparatus including means for updating the local register when personnel enter or leave the defined area.

10. Apparatus according to claim 1, in which each muster station is part of a defined area, the apparatus including means for updating the local register when personnel enter or leave the defined area, and the updating means includes an input device located at an entry to the defined area in signal communication with the controller.

11. Apparatus according to claim 1, in which the detector means include one or more identity tags, and at least one identity tag includes means for storing an identification code, the identification code being associated with an identifier associated with a person carrying the identity tag, and the controller is a programmable computer, which is programmable with a set of instructions, and the set of instructions includes an identity database which relates the or each identification code to the or each identifier.

12. Apparatus according to claim 1, in which the controller is a programmable computer, which is programmable with a set of instructions and the set of instructions includes a register database, which relates each identifier to a muster station.

13. Apparatus according to claim 1, in which the detector means include a plurality of identity tags, each of which is carried by a different person and includes a radio transmitter-responder (transponder) in the form of an RFID device.

14. Apparatus according to claim 1, in which each input device includes a radio transmitter and receiver and an antenna, which is arranged to create a read field space.

15. Apparatus according to claim 1, in which each input device includes a radio transmitter and receiver and an antenna, which is arranged to create a read field space, and the antenna is arranged to receive an identification code from an identity tag when the tag is within the read field space.

* * * * *